US005580062A

United States Patent [19]

Dehlinger

[11] Patent Number: 5,580,062

[45] Date of Patent: Dec. 3, 1996

[54] "RIP THAT CAN " CAN HOLDING DEVICE

[76] Inventor: Christian Dehlinger, 7 Pleasant St., Rockland, Me. 04841

[21] Appl. No.: 336,927

[22] Filed: Nov. 10, 1994

Related U.S. Application Data

[63] Continuation of Ser. No. 21,562, Feb. 24, 1993, abandoned.

[51] Int. Cl.[6] ..... F41J 5/00

[52] U.S. Cl. ..... 273/378; 273/390

[58] Field of Search ..... 273/348, 378, 273/386, 390, 391, 392, 407, 393

[56] References Cited

U.S. PATENT DOCUMENTS

| | | | |
|---|---|---|---|
| 2,722,420 | 11/1955 | Adamson | 273/407 |
| 3,540,729 | 11/1970 | Rarberger | 273/407 |
| 4,189,147 | 2/1980 | Schmid | 273/406 |
| 5,163,689 | 11/1992 | Bateman | 273/403 |

*Primary Examiner*—Mark S. Graham

[57] ABSTRACT

An aluminum beverage can is suspended in the air between two arms applying tension, outwardly pulling on the top and bottom of the can through a series of attachments including anchoring attachments to the arms attaching to swivels attaching to axle rods that attach to the top and bottom of the can. This array is supported by upright standards that are adjustable in height. The axle rods and anchors which attach to the arms have a shape that allows them to remain secured to the swivels and arms, but are easily disassembled as well. The can is held as a fired upon target during a game in which the shooter trys to shoot the can in two. The can spins on a central axis when a projectile strikes it off center. When large sections have been ripped away the can opens under the tension applied to it. The adjustable upright standards allow the can center to be positioned to the user's preference in relation to the bore line of the gun.

2 Claims, 2 Drawing Sheets

"RIP THAT CAN " CAN HOLDING DEVICE

This is a continuation of application Ser. No. 08/021,562, filed Feb. 24, 1993, abandoned.

BACKGROUND OF THE INVENTION

1. Field of the Invention

The present invention relates to a device that holds an aluminum beverage can as a fired upon target. More specifically, the present invention relates to a device that attaches to the top and bottom of an empty aluminum beverage can to hold it as a target during a specific, scored, shooting game.

2. Prior Art

An inanimate target enjoyed by shooters is the aluminum beverage can. When the can is hit by a projectile, the can is punctured and reacts with animated movement. This shooting is done in a leisurely fashion and no comparative score can be kept. I have invented a game in which scoring can be kept and compared when shooting at an aluminum beverage can. I have also invented a device that holds an aluminum beverage can for the efficient and enjoyable play of this game. So the can holding device can be better appreciated, a short explanation of the game is required.

The name of the game is Rip That Can (RTC). The goal of RTC is simple: place your shots from a single projectile gun one next to the other, bisecting the body of the can until it comes apart in two pieces. Score can be kept in various ways depending on the manner of play. The easiest method of scoring is to count the amount of shots that it took to Rip That Can and place this on a score card with distance and caliber. The scoring can be taken further. The dividend of the caliber fired into the circumference of the can in inches becomes a constant; i.e., a par. Now the shooter has a standard by which to judge their shooting. The percentage of shots it took to Rip That Can over or below par now allows shooters to make comparisons even when shooting different caliber guns. RTC can also be played as a timed event.

A special device would be required to hold an aluminum beverage can in a specific fashion for the most efficient playing of RTC. No device is known, however, to properly hold an aluminum beverage can for the playing of Rip That Can.

SUMMARY OF THE INVENTION

The principal object of this invention in its present form is to provide a device that would attach to the top and bottom of an aluminum beverage can, suspending the can and allowing the can to spin freely on a central axis as the can is struck by projectiles and at the same time provide a gentle tension that pulls at the top and bottom of the can, opening it up as the projectiles rip away large sections of the can's body, allowing the shooter to better see the attaching shreds.

It is an object of the invention that the device allow for the safe and efficient playing of Rip That Can.

It is also an object that the attaching pieces between the can and the upright standard sections of the device can be easily changed if they are damaged during play.

It is another object of the invention that said attaching pieces hold together but can be easily taken apart if need be.

It is an object that the user can load various size beverage cans.

It is still another object that the can's height in relation to the ground be adjustable.

It is also an object that the invention's design be applicable to both stationary and portable upright standards.

The foregoing objects of the invention can be accomplished by providing a device that has two slender connecting rods that attach to the top center and bottom center of an aluminum beverage can at one end of their length and to ball bearing swivel bodies at the other end of their length. One end of each rod is bent or molded into a shape that allows it to pass through the small hole in the ball bearing swivel body and stay there until they need to be removed. The other ends of these rods have hook and right angle bends that allow them to hook the hole in the can's tab or be hooked into the can itself through a small hole punched into the can by the user. These rods are the axles which will transfer the energy of the striking projectile to the ball bearing swivel bodies. The ball bearing swivel bodies allow striking projectiles to spin the can when it is hit off of the central axis. At the opposing end of the ball bearing swivel bodies are bases that pass through the swivel bodies (as do the rods) and loop around simple arms which are equally spaced from each other by the axle connecting rods, the ball bearing swivel bodies and the anchoring loop bases. The arms are under gentle tension. This tension pulls against the attaching bases, the swivel bodies, the axle connecting rods in turn pulling against the top and bottom of the can, allowing the can to open when a large section of it's body is ripped away by the projectiles. The tension can be created by flex within the arm itself or applied spring tension. These arms attach to an upright standard or standards that are adjustable in height. The base has to only serve a supporting role in the device. Examples of bases would be: a spike with a foot cleat, a flat panel, or the upright standard cemented into the ground.

DETAILED DESCRIPTION

Figure 1:
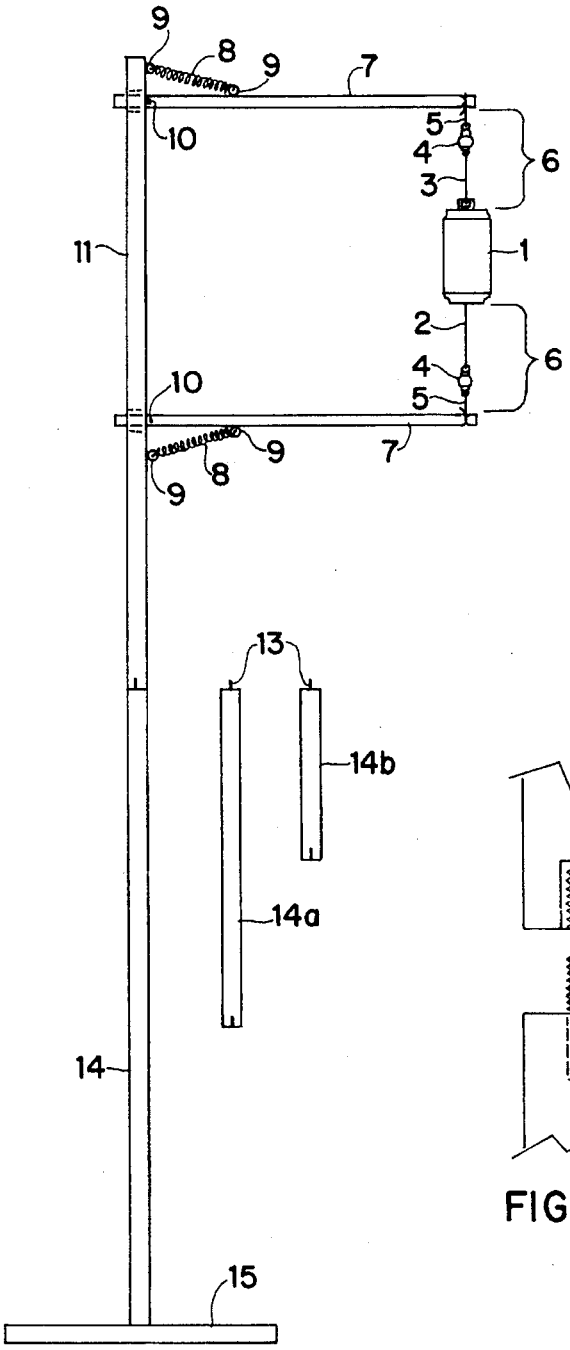
FIG. 1 is a side elevation of the RTC can holding device in accordance with the present invention.
Figure 3:
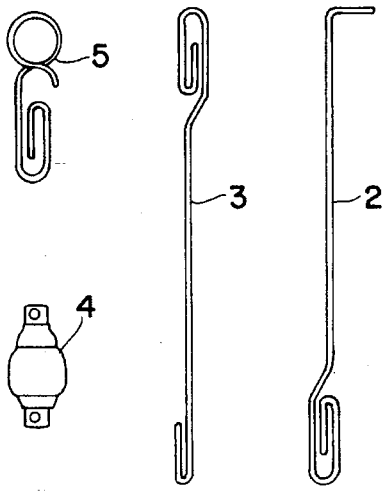
FIG. 3 is an enlarged overhead of the assemblies, removed from the arms and disassembled.
Figure 6:
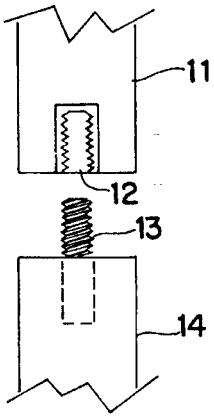
FIG. 6 is a enlarged, fragmentary, cutaway, side elevation of the center section of the top and bottom upright standards.
Figure 5:
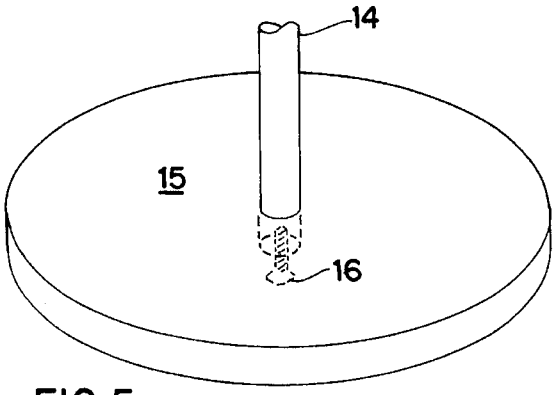
FIG. 5 is an enlarged, fragmentary, cutaway, angled overhead of the bottom of the upright standard and a base.

As shown in the drawings, the RTC can holding device in its present form includes top and bottom axle connecting rods 2 and 3, best viewed in FIG. 3. Rods 2 and 3 are made of stiff spring wire. This material allows rods 2 and 3 to be bent into and hold their shape, even during the glancing blow of a projectile. The stiffness of rods 2 and 3 also allows for the efficient transfer of energy from a projectile hitting the can 1 off of the center axis to the ball bearing swivel bodies 4. This transfer of energy allows the can 1 to spin. The spinning of the can 1 allows the user to see the full circumference of the can 1. The end of rod 2 that enters the can 1 is bent at a right angle to itself. This short length is inserted through a small hole the user has punched into the bottom center of the can 1. The end of rod 3 that attaches to the top of can 1 is bent into a tight little hook. The opening tab of the can 1 is pulled straight up and the small hook of rod 3 is placed through the existing hole in the opening tab and hooked into place. If the opening tab does not exist or comes off during play, a small hole can be punched through the center rivet that held the tab in the top of the can 1 and rod 3 can then be hooked into this. The opposing end of rods 2 and 3 have the same distinctive shape. This shape is like that of a shortened paper clip, with the length of rods 2 and 3 being bent back on itself with two, round 180 degree bends. This makes for three short lengths to be parallel to each other with two of them touching. This allows rods 2 and 3 to be threaded through the holes in ball bearing swivels 4, have the two parallel lengths that touch snap back together and stay that way during assembly or disassembly, packing and unpacking of a portable RTC can holder, and when the can 1 is ripped in two and the arms fly open. Just after the two double bends in rods 2 and 3 proceeding toward the can 1, there is a small "S" curve that puts the axle portion of rods 2 and 3 back to the center axis.

The ball bearing swivel bodies 4 located at the outer ends of rods 2 and 3 are there to allow the can 1 to spin when a projectile hits the can 1 off center. This allows the shooter to move a new area of the circumference or "face" of can 1 into view. This spinning is a large part of what will help the shooter shoot a below par score. The spinning provided by swivels 4 is also an enjoyable part of playing RTC, giving the game an arcade like feel. The energy transfer from a small caliber high speed projectile is slight. This is why ball bearings swivels 4 are used over less expensive types of swivel bodies with greater friction. The ball bearing swivel bodies 4 are a standard manufactured item and are the basis of high quality fishing swivels. They are available in several standard sizes. These sizes are numbered by the swivel companies. These sizes are standardized and number 1 to 8 with 1 being the smallest. All but the first two or three sizes are applicable to the invention in it's present form.

Figures 2, 4:
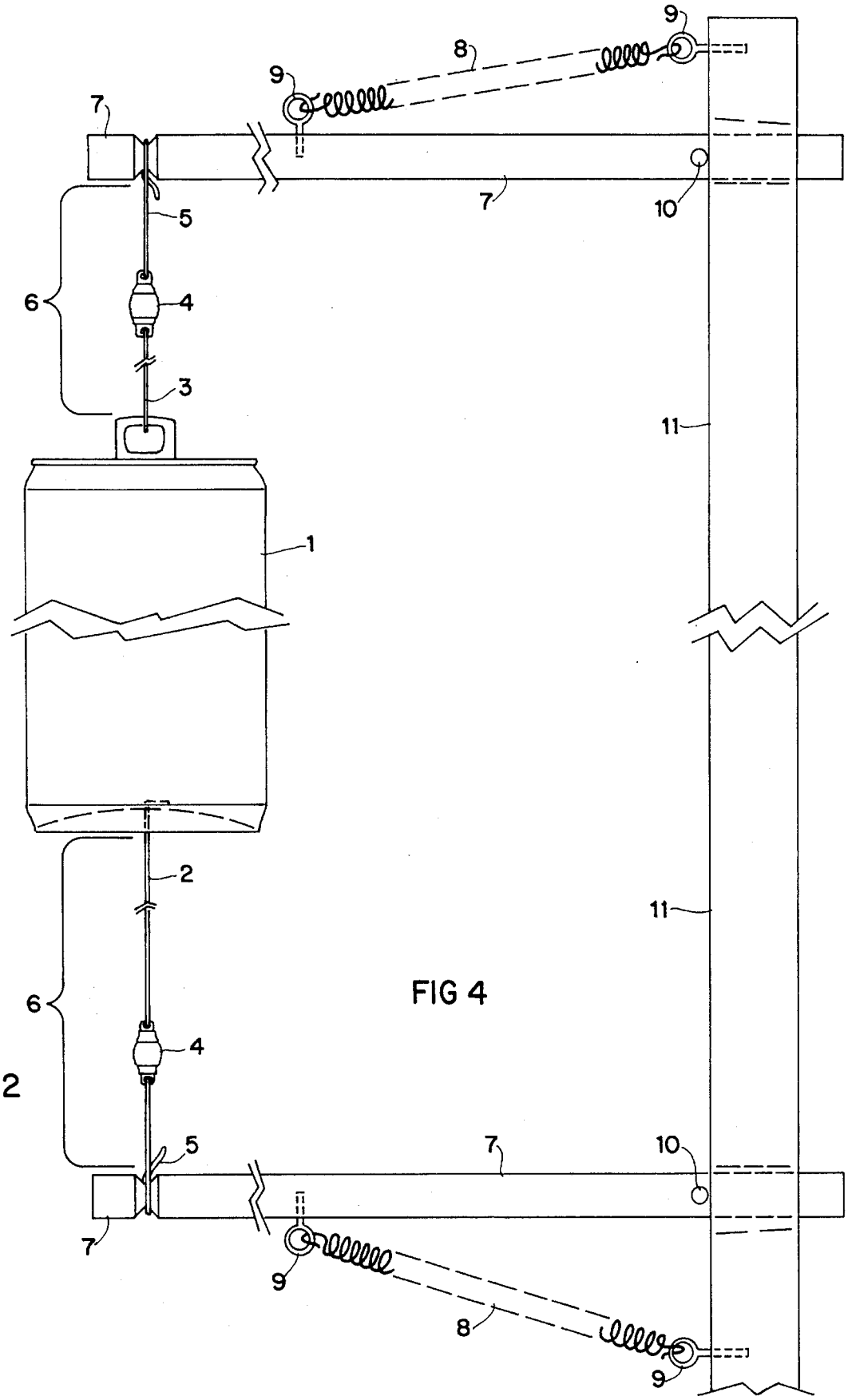
FIG. 2 is an enlarged, fragmentary, side elevation of the can, assemblies and arms.
FIG. 4 is an enlarged, fragmentary, cutaway from a side elevation of the arms attaching to the upright standard.

At the opposing end of swivels 4 to the can 1, are the wire loop bases or clips 5. The wire loop bases 5 are the anchors of the completed assemblies 6 to the arms or limits 7. This can best be seen in FIG. 2. A complete assembly 6 is from the can 1 outward, rod 2 or 3 attached to a swivel 4, attached to a wire loop base 5. The wire loop bases 5 are made of the same stiff spring wire as rods 2 and 3. The end of the bases 5 that pass through the swivels 4 has the same paper clip styled 180 degree bends as do rods 2 and 3. This allows a swivel 4 to stay in place but be easily removed if they are damaged during play without removing the loop base 5 from the arm 7. The opposing end of the wire loop bases 5 to the swivels 4 is formed into a circle. The end of the wire continues past the 360 degree point to form a contact area for the thumb. This can best be viewed in FIG. 3. At rest the inside diameter of the loops of the wire loop bases 5 is slightly smaller than the outside diameter of a groove cut into the arms 7 as best seen in FIG. 2. By holding the 180 degree bends of the bases 5 in the crotch of the index finger and pressing the thumb against the contact area formed by the end of the wire, the loop bases 5 can be expanded to slide over the ends of the arms 7, and snap into grooves cut near the ends of arms 7.

The arms 7, in keeping with the present form of the Invention, are wooden dowels about 18 inches in length and about one-half of an inch in diameter. At the end of arms 7 opposing the assemblies 6 are pins 10. The pins 10 pass completely through arms 7 and exit equally on each side of arms 7 about one-half inch. The pins 10 stop the arms 7 from sliding through the hole in top standard 11.

There are four screw eyes 9. These are the anchors for the extension type springs 8. Two of the screw eyes 9 are located about four inches from the opposing ends of the arms 7 to the assemblies 6, mounted perpendicular to the pins 10. The other two screw eyes 9 are located about two inches above and below the arms 7 in the top standard 11. This is best seen in FIG. 4. When the springs 8 are connected to the screw eyes 9 the arms 7 are pulled away from each other in a radial path off of pins 10. This is allowed by the holes that pass through top standard 11 having a slotted shape.

The top standard 11 in it's present form is made from a wooden dowel about three feet long and about one inch in diameter. At the lower end of the top standard 11 is a metal insert 12 with female inside threads. The female threaded insert 12 is set flush to the bottom of the top standard 11 and allows the top standard 11 to be mated to a male threaded post 13 and screw together in a pool cue fashion with the bottom standard 14. The top standard 11 has two slotted holes about 18 inches apart. These holes pass perpendicular to the length of top standard 11.

The bottom standard sections 14, **14*a* and 14*b* are made from wooden dowels about one inch in diameter. Bottom standard section 14 is about thirty-six inches long, section 14*a* is about twenty inches long and section 14*b* is about ten inches long. Each of these sections have female threaded inserts 12 in one end and male threaded posts 13 in the other. This allows the user to make simple height adjustments for their height, to put the center of the can 1 more on a straight line with the bore of the gun. This makes for efficient play when the entrance and exit holes made by the projectile are equal distance from one end of can 1. The female threaded inserts 12 mate with the threaded post of screw 16 that protrudes about an inch from the base 15**.

The base 15 in it's present form is made from three fourths of an inch thick plywood cut into a fourteen inch diameter circle. In the center of the base 15 is a flat head machine screw 16 which is screwed through a smaller diameter counter-sunk hole until the head is flush with the bottom of base 15.

The described RTC can holding device allows the user to take an empty aluminum beverage can 1, punch a small hole in it's bottom center, place the crooked end of axle rod 2 into the hole, pull axle rod 3 down with the other hand, and hook it into the can 1 tab. The can 1 is now suspended under gentle tension between assemblies 6. The radial movement of the arms 7 allow the user to load various size aluminum beverage cans 1. The user may now take several paces backwards away from the RTC can holding device. As he/she shoots for the center of the can 1, trying to connect his/her shots, he/she is delighted with the spinning of the can 1 and will learn to use this as he/she becomes more seasoned. As the shots connect, gaping holes open because of the tension applied by the arms 7 through the assemblies 6. When the final projectile rips through the last shred of the can 1, the arms 7 spring open giving the user his/her just reward!

There is no fear of injury to the user because none of the materials used will cause any projectile to be deflected directly back at the user.

The foregoing description of the preferred embodiment of the invention has been presented for the purposes of illustration and description. It is not intended to be exhaustive or limit the invention to the precise form disclosed. Many modifications and variations are possible in the light of the above teaching. It is intended that the scope of the invention be limited not by this detailed description, but rather by the claims appended hereto.

I claim:

1. A can target holding device for parting a can comprising:

a. two aligned and spaced limbs, which are drawn in opposing directions under spring tension, having ends which move in a radial path;

b. two opposing clips, having ends shaped as closed loops, which are firmly mounted to said ends of said limbs;

c. two low friction swivel devices, each having an end threaded into a respective said loop of said clip;

d. two rods, each having an end shaped as a closed loop, which threads through an opposing end of said swivel;

e. one of said rods having an opposing end which readily attaches to the top of a prepared can, the other said rod having an opposing end which readily attaches to the bottom of a prepared can;

f. an upright standard which stands generally perpendicular to the ground and supports said limbs.

2. The device of claim 1 wherein said limbs are capable of enough travel and continual tension to stretch open the can when all but one strip of its circumference has been removed by projectiles and said clips, swivels and rods form and maintain a center axis.

* * * * *